United States Patent [19]

Schmidt

[11] 4,127,966

[45] Dec. 5, 1978

[54] LOCKING AND EMERGENCY RELEASE SYSTEM FOR BARRED WINDOWS

[75] Inventor: Oscar W. Schmidt, Hesperia, Calif.

[73] Assignee: New Pneumatics, Inc., Greeley, Colo.

[21] Appl. No.: 826,535

[22] Filed: Aug. 22, 1977

[51] Int. Cl.[2] ..... E06B 9/02

[52] U.S. Cl. ..... 49/141; 49/56; 49/394; 292/252

[58] Field of Search ..... 49/141, 56, 57, 394; 292/252; 70/24

[56] References Cited

U.S. PATENT DOCUMENTS

| | | | |
|---|---|---|---|
| 3,186,196 | 6/1965 | Moberg | 292/252 X |
| 3,737,193 | 6/1973 | Cain | 49/141 X |
| 4,057,935 | 11/1977 | Rohrberg | 49/141 X |

FOREIGN PATENT DOCUMENTS

| | | | |
|---|---|---|---|
| 1915971 | 10/1970 | Fed. Rep. of Germany | 49/141 |

*Primary Examiner*—Kenneth Downey

*Attorney, Agent, or Firm*—Poms, Smith, Lande & Glenny

[57] ABSTRACT

The heavy iron gratings for a burglar-proof window are pivotally mounted on one side. The other side is provided with a latch type locking mechanism using a plunger having a ramped surface to hold a set of ball bearings in locking engagement with a matching cylinder. A small carbon dioxide container is mounted within the latch and is spring loaded with a detent arranged for actuation from within the home which is being protected. When the detent is released, a spring-loaded plunger punctures the carbon dioxide container, and a ramped latching plunger is moved to release the locking ball bearings, and then the iron grating or barrier is then vigorously swung open by the pneumatic pressure from the punctured container.

6 Claims, 4 Drawing Figures

Fig. 1
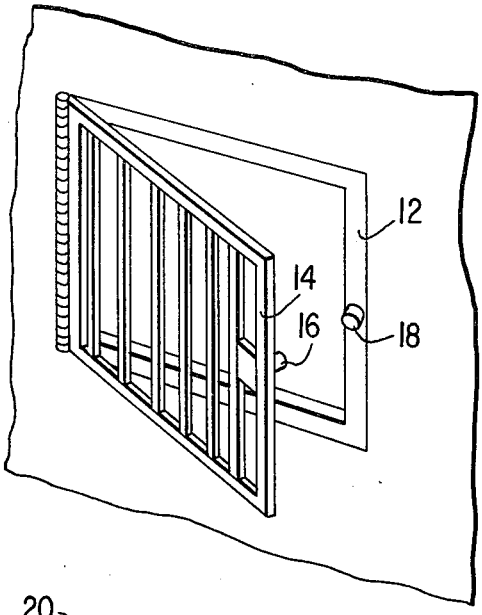
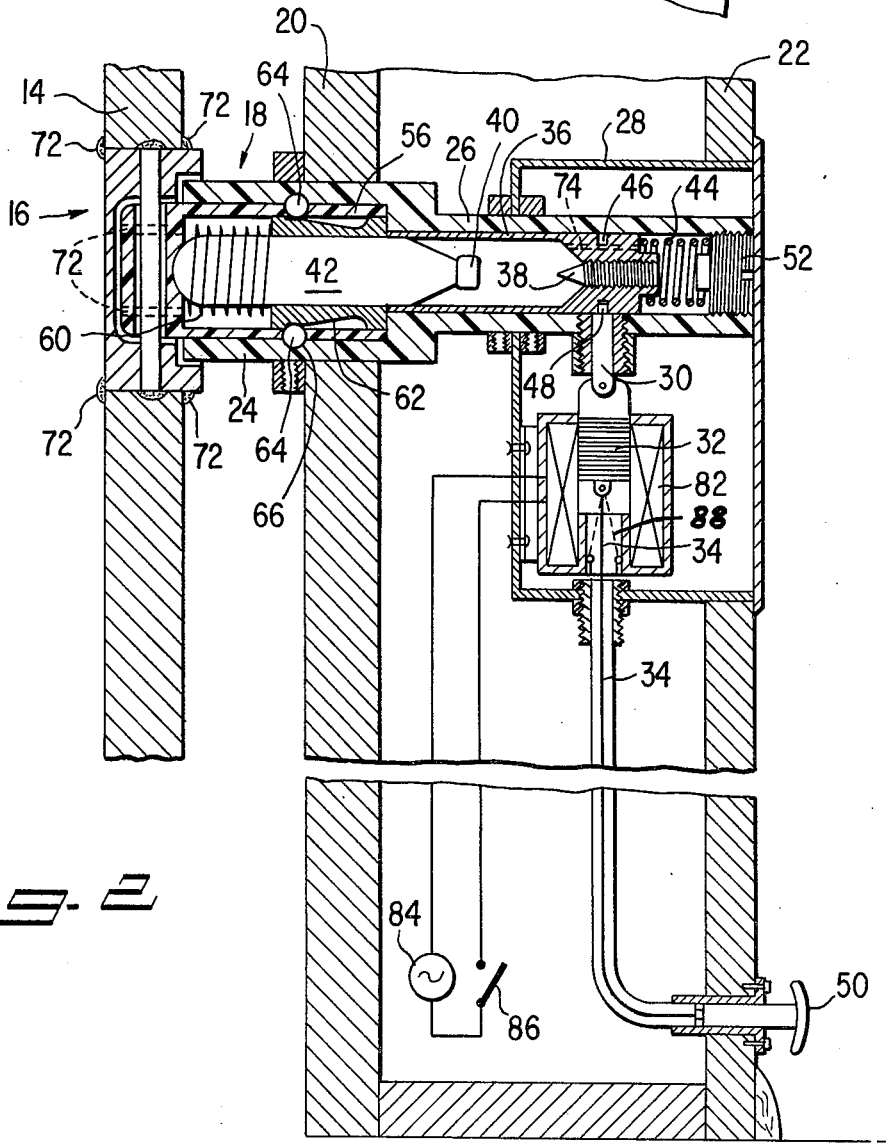
Fig. 2

LOCKING AND EMERGENCY RELEASE SYSTEM FOR BARRED WINDOWS

FIELD OF THE INVENTION

This invention relates to safety release mechanisms for barred windows or doors.

BACKGROUND OF THE INVENTION

Conventional burglar bars, the heavy iron gratings or grilles which protect the windows of some homes to keep out intruders, have recently been outlawed in a number of jurisdictions because many people have died in house fires, trapped by their own security bars.

Accordingly, a principal object of the present invention is to provide a quickly releasable safety latch for security bars which will not only be tamper-proof from the outside, but which will also positively release when actuated from the inside.

SUMMARY OF THE INVENTION

In accordance with a broad aspect of the invention, a safety locking and emergency release system for barred windows or doors includes positive mechanical interlocking arrangements, a spring loaded release mechanism, and a source of pressurized gas which is released as the spring loaded release mechanism is operated, and the mechanical interlocking mechanism is opened, with the pneumatic pressure swinging the metal bars or other barrier open.

In a preferred form of the invention, a movable piston and an enclosing cylinder are provided, and a container of pressurized gas is located within the cylinder. The outer wall of the piston is provided with a ramped surface and interlocking members, such as ball bearings, are normally held into a groove in the wall of the cylinder by the outer ramped surface of the movable piston. When the spring loaded release mechanism is triggered, it releases the gas and engages the piston. The piston then moves, and the ramp surface is configured so as to release the interlocking members; then, the gas pressure swings the barrier back to permit ready egress from the previously barred window.

The spring-loaded release mechanism for a carbon dioxide type cylinder is provided with a detent holding the spring-loaded release mechanism from movement. When a remote trigger is actuated, the detent is pulled back, thus setting the release mechanism into action with a consequent flow of pressurized gas, and a release of the mechanical interlock, and then the actuation of the barrier into its open position. Preferably, the trigger is located at least a few feet away from the barred window so that a burglar could not easily reach into the structure and release the trigger.

Other objects, features, and advantages of the invention will become apparent from a consideration of the following detailed description and from the accompanying drawing.

BRIEF DESCRIPTION OF THE DRAWINGS

FIG. 1 shows an overall view of a window equipped with a locking and quick released device of the present invention;

FIG. 2 is a cross-sectional view showing the inner construction of the device in the normal locked position;

DETAILED DESCRIPTION

Figure 3:
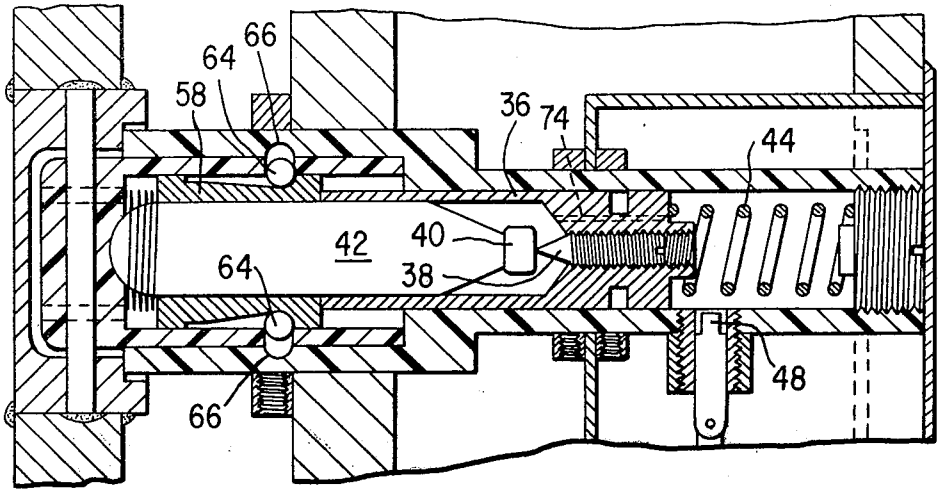
FIG. 3 is a cross-sectional view showing the device at the instant when the unit has been actuated and the gas cylinder has been opened.

With reference to the drawings, FIG. 1 shows a window frame 12 equipped with a hinged burglar grille or iron grating 14. Secured to the grille 14 is one portion 16 of the locking and emergency release apparatus of the present invention, with the mating portion 18 being secured into the window frame 12.

FIG. 2 is a cross-sectional view showing the safety lock and releasing mechanism of the present invention in cross-sectional form. In FIG. 2 the burglar grating is shown at 14 with the attached outer portion of the locking apparatus 16 secured to it, and the outer wall of the building 20 which contains the window 12 is shown in cross-section, as is the inner wall 22 of the building.

With reference to the details of construction, the portion of the mechanism which is secured to the house includes the larger diameter cylinder 24 which extends out from the house toward the grille 14, and the cylindrical portion of reduced cross section 26 which is completely embedded in the wall. A mounting box 28, similar in construction to a normal electrical box which is secured in the walls of a home, is employed to contain the inner end of the cylindrical member 26 as well as the detent 30 and the linkage 32 by which the detent 30 is secured to an actuating cable 34. Within the inner cylinder 26 is a movable hollow piston 36 which carries a sharply pointed screw 38 which is employed to break the seal at the end 40 of the carbon dioxide cylinder 42, as described in more detail below. The movable cylinder 36 is spring loaded by a heavy spring 44. A recess 46 is provided around the periphery of the movable cylinder 36, and the detent 30 has its end 48 located in the recess 46 to hold the spring-loaded cylinder 36 with its pointed screw 38 against movement, until such time as the detent is intentionally removed by pulling the handle 50 which may be located on or near the base board of the house or other building. It may be noted in passing that the heavy screw 52 is employed to compress spring 44 and load the movable cylinder 36 for movement to the left as shown in FIG. 2 at such time as the detent 48 is retracted.

Consideration will now be given to the assembly 16 which is the mating portion of the locking and quick release apparatus of the present invention. This member 16 includes an outer cylindrical portion 56 and an inner cylinder 58 which is movable with respect to the outer cylinder 56, and which is normally spring biased toward the right by a relatively weak spring 60. The carbon dioxide cylinder 42 is mounted within the inner cylinder 58.

The outer surface of the movable cylinder 58 is provided with a ramped surface 62 to control the movement of metal balls 64 which are similar in shape and construction to ball bearings. The outer cylinder 24 is provided with an inner groove 66 into which the balls 64 fit when the inner sleeve 58 is in its locking position as shown in FIG. 2. In this position the ramp 62 has forced the balls 64 outwardly in the holes in cylinder 56 in which they are located so that they rigidly engage groove 66, and thereby provide a positive mechanical interlock which prevents movement of the protective grille 14.

Incidentally, of course, the unit 16 is welded to the protective grille 14 as indicated at 72.

Reference will now be made to FIG. 3 which shows the system immediately following release of detent 48 by actuation of the handle 50. As shown in FIG. 3, the heavy spring 44 has forced the cylinder 36 with its sharply pointed screw 38 forward to engage the carbon dioxide cylinder 42 immediately subsequent to the instant shown in FIG. 3, the end 40 of the carbon dioxide cylinder is pierced, releasing the gas. In addition, the forward movement of the cylinder 36 moves the inner cylinder 58 to the position where the balls 64 can move out of the recess 66.

Figure 4:
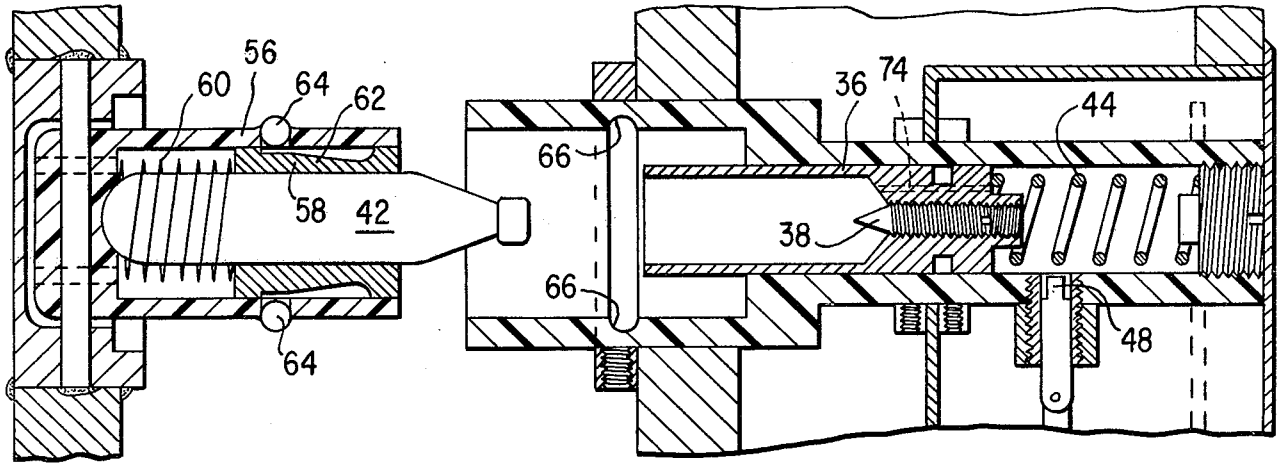
FIG. 4 shows the next stage of release in which the bars are swinging open.

FIG. 4 shows the next stage in which the compressed air from the carbon dioxide cylinder 42 has swung the protective grille 14 open to permit egress through the window 12 and escape from the building. It may be noted in FIG. 4 that cylinder 58 has now been returned to its original position by the force of the spring 60 and that the balls 64 are now in their protruding position as a result of the force of the ramp 62. In addition, the recess 66 is more clearly visible in FIG. 4.

At a subsequent time the apparatus of FIG. 4 may be reset to the configuration shown in FIG. 2 with a new carbon dioxide cylinder inserted into position.

Incidentally, concerning a matter not mentioned above, small vent holes 72 and 74 are provided to insure freedom of movement of pistons 58 and 36 respectively. In the absence of such vent holes, air trapped within the unit might block free movement of these two inner pistons.

It may also be noted that, as described above, the release mechanism was actuated manually by pulling release handle 50 (see FIG. 2); however, the release mechanism may also be actuated electrically by the energization of solenoid 82 as shown in FIG. 2. Referring again to FIG. 2, the member 32 serves not only as a mechanical linkage to interconnect detent member 30–48 with release cable 34, but is a plunger of magnetic material which is pulled into solenoid 82 when it is energized to free detent 82, and initiate operation of the barrier release mechanism as described above. The electrical circuit for the solenoid 82 is shown schematically with a suitable source of power 84 and a remote switch 86. The power may be 110 volt house current, and the remote switch 86 may be located on the inner wall 22 away from the window, or may be part of a fire detection and alarm system. Any suitable biasing arrangements such as a conventional plunger biasing spring 88 may be provided to normally apply a relatively weak upward biasing force to plunger 32. This weak biasing force is easily overcome by the magnetic pull of the solenoid 82 or a manual pull applied to release handle 50.

STATEMENT OF PRIOR ART

The following prior art references are made a record in the present case:

E. Elias, U.S. Pat. No. 3,442,048 granted May 6, 1969 and entitled "Ejectable Window for a Passenger Vehicle".

R. H. Cain, U.S. Pat. No. 3,737,193, granted June 5, 1973 and entitled "Windshield Ejector for Vehicles".

W. R. Black, Sr., U.S. Pat. No. 3,921,334, granted Nov. 25, 1975, and entitled "Window Guard Apparatus".

C. Klein, U.S. Pat. No. 3,953,939, granted May 4, 1976, and entitled, "Movable Grill Guard".

Concerning the first two references, these both relate to ejectable windows for cars or busses. Neither of the two references have positive mechanical interlocks for holding the windows in place, even if they were assumed to be the equivalent of the burglar-proof barrier disclosed and claimed in the present specification. Thus, for example, in the Elias patent, the window is held in by an inflated tube, and apparently would automatically eject in the event that the pressure would gradually leak out of the tube or if the window were merely forced vigorously outwardly. Similarly, in the case of the Cain patent, the window is merely held in by a bead of rubber and could presumably be easily kicked out or removed with a heavy suction member from the outside. The Elias and Cain patents are pertinent in the use of gas pressure, but with the Elias patent using the inflated tube to retain the window in place while the Cain patent discloses inflating the tube to cause the rubber bead to be bent back to release the window. These arrangements are in contrast with the action of the present device in which the heavy compression spring and the gas cylinder both operate to apply force in the same direction once the manual actuator is operated to release the barrier.

The two patents relating to burglar bars or grilles, the patents to Klein and Black, both include mechanical interlocks, but no action of a compressed spring or compressed gas to release the bars. Instead, the operator must provide the entire force for either depressing the release mechanism in the Black patent, or operating the mechanical gearing to effect a release in the case of the Klein patent. The simple operation of the manual detent release mechanism 50, as shown in FIG. 2, serves to release the compressed energy of both spring 44 and the $CO_2$ cylinder 42, both of which act to release and push open the burglar barrier 14. This mode of operation is not disclosed by any of the references, either individually or in any valid combination of them.

In closing, it is to be understood that minor mechanical variations from the illustrated arrangements may be employed in the implementation of the claimed invention.

What is claimed is:

1. A locking and emergency release system for barred windows or doors comprising:

a movable burglar-proof barrier for a window or door;

positive and rigid mechanical latching means for normally locking said barrier into its closed position across a window or door in a building;

said latching means including movable piston means located in a cylinder, constituting first and second telescoping mechanically interlocking means secured to the barrier and the building;

a cannister of pressurized gas mounted in said cylinder;

actuating means, including cannister piercing means for releasing said gas, and for unlocking said positive mechanical latching means and moving said barrier away from said window or door with said gas applying opening force to said barrier, to permit egress from said building;

said actuating means including a plunger telescopically enclosed within said cylinder;

spring means for supplying actuating force to said actuating plunger;

detent means for restraining said plunger against movement; and manual or electrical means for releasing said detent means to thereby release said actuating means to unlock said latching means, pierce said cannister of gas and apply opening force to said barrier.

2. A system as defined in claim 1 wherein said cannister of compressed gas is mounted on said movable piston.

3. A system as defined in claim 1 wherein said movable piston is provided within an external ramped surface and said interlocking means engage and are actuated into the locking or released position by said ramped surface.

4. A system as defined in claim 1 wherein said interlocking means includes movable balls, and matching recess means in the walls of said cylinder for receiving said balls.

5. A locking and emergency release system for barred windows or doors comprising:

a burglar-proof barrier for a window or door;

positive and rigid mechanical latching means for normally locking said barrier into its closed position across a window or door in a building;

means including a piston containing both a cannister of compressed gas and a compressed heavy duty spring for providing a powerful dual source of energy under compression;

actuating means including means for unlocking said positive mechanical latching means and for piercing said cannister of compressed gas, said actuating means being in the path of said heavy duty spring and restraining said heavy duty spring in the compressed state;

detent means separate from said latching means for holding said actuator against movement under the force of said spring;

means for releasing said detent to permit movement of said actuator to release said latching means and pierce said cannister, thereby throwing said barrier open.

6. A system as defined in claim 5 wherein said release means includes alternative manual release means and solenoid release means for releasing said detent means.

* * * * *